US006089464A

United States Patent [19]

Morgan

[11] Patent Number: 6,089,464

[45] Date of Patent: Jul. 18, 2000

[54] THERMAL DYNAMIC BALANCER

[76] Inventor: Kenneth A. Morgan, 630 Riverside Rd., North Palm Beach, Fla. 33408

[21] Appl. No.: 09/303,326

[22] Filed: Apr. 29, 1999

[51] Int. Cl.[7] ..... F24F 7/02

[52] U.S. Cl. ..... 236/49.3; 165/108; 165/248

[58] Field of Search ..... 62/DIG. 16, 259.1, 62/263; 236/49.3; 165/108, 248

[56] References Cited

U.S. PATENT DOCUMENTS

| | | | |
|---|---|---|---|
| 4,139,052 | 2/1979 | Lackey | 62/263 |
| 4,281,522 | 8/1981 | Bussjager | 62/DIG. 16 |
| 4,683,942 | 8/1987 | Bierkamp et al. | 62/259.1 |
| 5,249,596 | 10/1993 | Hickenlooper, III et al. | 137/334 |
| 5,425,502 | 6/1995 | Weng et al. | 236/13 |
| 5,673,851 | 10/1997 | Dozier et al. | 236/49.5 |

*Primary Examiner*—William E. Tapolcai
*Attorney, Agent, or Firm*—McHale & Slavin, PA

[57] ABSTRACT

The present invention is directed toward a VAV (variable air volume) air conditioning system which is capable of varying the supply air volume to a space based upon discharge temperature while simultaneously maintaining constant ventilation. The thermal dynamic balancing system of the present invention includes a bypass air box and an outside air ventilation box, each having adjustable dampers, which are controlled, in concert with one another, to provide a system which constantly dehumidifies the air in the conditioned space while simultaneously maintaining the discharge air temperature and degree of ventilation at constant values.

6 Claims, 1 Drawing Sheet

THERMAL DYNAMIC BALANCER

FIELD OF THE INVENTION

This invention relates to variable air volume (VAV) central ventilation and air conditioning systems; and particularly to VAV systems for maintaining a particularly programmed discharge temperature setpoint while simultaneously maintaining constant ventilation within the structure.

BACKGROUND OF THE INVENTION

VAV (variable air volume) air conditioning systems typically employ multiple zones by utilizing VAV boxes with thermostats in each zone and a static pressure sensor to modulate the supply air fan on the air conditioning system. Such systems provide adequate dehumidification in multiple zones, however, the ventilation system must be coordinated by a control system in order to maintain positive pressure within the building. In order to improve and maintain indoor air quality, the amount of ventilation air brought into the building space has been on the increase. As the amount of ventilation air increases, variable volume air conditioning systems monitor the space within a single zone for space temperature and vary the air volume with a constant discharge air temperature to maintain the temperature setpoint. Such systems also require the ventilation fans to be coordinated with supply fans to maintain positive building pressure. Such VAV systems typically include costly and complicated systems such as inlet guide vanes, discharge air dampers, and frequency drives to modulate air flow. These systems also require testing and balancing in the field to ensure adequate airflow and discharge temperature to the conditioned space. Furthermore VAV systems typically employ controls which cycle compressors for cooling capacity to maintain specific discharge temperatures. In some instances it is further necessary to provide hot gas bypass or freeze protection devices to keep the evaporator from freezing at low airflows.

PRIOR ART

U.S. Pat. No. 5,673,851 is drawn to a variable air volume diffuser which requires an air induction assembly including a flow control element movably mounted to control the volume of supply air discharged from the diffuser. This system requires fluid coupling of the air induction nozzle to the ventilation air assembly and ventilation air flow is controlled independently of and decoupled from the variable flow rate of supply air from the central air conditioning supply air source.

U.S. Pat. No. 5,425,502 is drawn to a VAV air conditioning system which requires a by-pass air supply fan and heat exchange pipe assembly. These components are controlled by a microcomputer. This system requires multiple fans controlled by the microcomputer to work in concert with various sensors to maintain equilibrium conditions about particular setpoints.

U.S. Pat. No. 5,249,596 describes a residential heating and air conditioning system which requires a barometric bypass damper which has an adjustable mechanism for adjusting the pressure set point of the damper.

None of the above-described prior art systems show a VAV system, capable of continually dehumidifying the discharge air to the conditioned space while maintaining constant ventilation, and further embodying a packaged unit which self-balances on discharge air temperature, thereby avoiding performance fluctuations owing to particular job-site conditions.

SUMMARY OF THE INVENTION

The present invention is directed toward a VAV (variable air volume) air conditioning system which is capable of varying the supply air volume to a space based upon discharge temperature while simultaneously maintaining constant ventilation. The thermal dynamic balancing system of the present invention includes means, in the form of a bypass air box and an outside air ventilation box which are controlled, in concert with one another, to provide a system which constantly dehumidifies the air in the conditioned space while simultaneously maintaining the discharge air temperature and degree of ventilation at constant values.

It is therefore an objective of the instant invention to continually dehumidify discharge air while maintaining constant discharge air temperature and constant ventilation to the conditioned air space.

It is a further objective of the instant invention to provide a packaged unit that self-balances based upon discharge air temperature, thus requiring no additional coordination to maintain humidity in the space.

It is still a further objective of the instant invention to provide cost-effective single zone VAV air conditioning which effectively dehumidifies the air in conditioned spaces which require large percentages of outside air.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
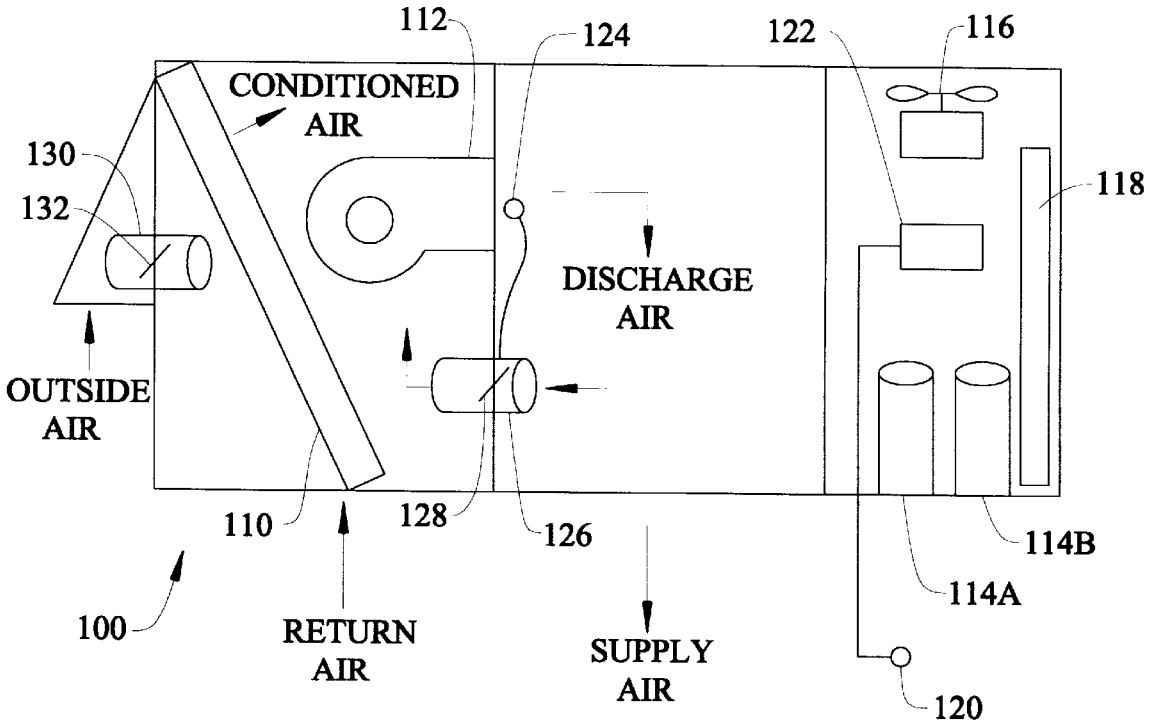
FIG. 1 shows a side plan view of the thermal dynamic balancer including all necessary components to provide variable air volume with constant ventilation.

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

With reference to FIG. 1, a packaged air conditioning unit 100 is shown; this is also applicable to a split system. The system, which is typically designed for rooftop installation or an indoor air handler as a split system, is capable of delivering supply air at a programmed discharge setpoint, for example 55° F. while maintaining constant ventilation to the air space. The system includes means for modifying airstream temperature to produce a conditioned airstream whereby enhanced humidity control of said airstream is achieved, typically an evaporator coil 110, through which a blend of both outside and return air flow. Further provided is a means for circulating air having a suction side and a discharge side, typically a supply fan 112, wherein a variable mixture of return air and outside air flow through the evaporator coil 110 and the resultant conditioned airstream is supplied to the supply fan 112 suction side and thereby forms a discharge airstream at the supply fan's discharge side. The packaged unit contains one or more means for providing a source of heating or cooling, e.g compressors 114*a* and 114*b,* in conjunction with condenser fan 116 and condenser coil 118. The compressors are controlled in a stagewise fashion as a function of the temperature within the air conditioned space, as determined by sensor 120, which communicates this information to a control panel 122 which determines if heating or cooling is needed and how many stages of each are calculated to be required in order to meet the desired interior space zone temperatures. Means communicating the heating or cooling refrigerant to the evaporator coil 110, may for example be copper tubing (not shown) providing a closed circuit between the compressor(s) and the evaporator coil 110. If necessary, electric resistance heaters (not shown) may be provided. As mixed air travels through the evaporator coil 110 and enters the suction side of the supply fan 112, air is discharged from the supply fan 112 over discharge air temperature sensor 124 and into the supply air ductwork (not shown). The discharge air temperature sensor may be adjusted for any temperature discharge air. The discharge air temperature sensor, which is wired to the bypass air VAV box 126, having built-in flow sensors and controls (not shown), provides a means for controlling the rate of recycle of the discharge airstream. If the discharge airstream temperature exiting from the supply fan 112 is higher than the discharge airstream temperature setpoint, then the bypass damper 128 in the VAV box 126 will start to open, thereby short cycling air from the positive or discharge side to the negative or suction side of the fan 112, to reduce the overall airflow across the evaporator coil 110. This causes the discharge air temperature to drop. Once the discharge air temperature setpoint is reached, the sensor 124 communicates with the bypass air VAV box 126, causing it to modulate the flow by moving the damper 128 so as to maintain a constant temperature at the supply fan 112 discharge. If the discharge air temperature is less than the setpoint, then the bypass damper 128 will close to thereby increase the overall volume of airflow across the evaporator coil 110. As the bypass air box 126 modulates, the amount of air crossing over evaporator coil 110 likewise increases and decreases, with resultant fluctuations in the volumetric flow rate of outside and return air. To maintain building pressurization, a means for adjusting the rate of ingress of outside air is provided, specifically, an outside air ventilation box 130 containing a built-in flow device and controls (not shown) which enable it to maintain a programmed air volumetric flowrate. As the amount of air short cycles to the supply fan 112, through bypass box 126, outside air ventilation box 130 modulates to maintain a constant volumetric flow rate of outside air across evaporator coil 110, thereby providing a means for maintaining and adjusting outside air flow as a function of discharge air recycle.

In normal operation, the rate of recycle of the discharge airstream is modulated in response to variations in the temperature of the discharge airstream and the means for adjusting the rate of ingress of outside air are simultaneously modulated whereby the volume of outside air supplied to the system is maintained at a constant value.

In the specific embodiment of FIG. 1, the rooftop unit is designed to vary the air volume based on a discharge air temperature sensor 124 by modulating a bypass damper 128 within the unit to maintain a programmed discharge air temperature. As the air volume within the unit fluctuates, a second damper 132 modulates to provide constant ventilation to the space. Therefore, the supply air system operates like a single zone VAV system while the outside air system modulates the dampers to change the path resistance so that the ventilation remains constant. Both the bypass damper 128 on the supply ductwork and the outside air damper 132 include air monitoring devices (not shown) in the form of a flow ring and microprocessor controls to maintain accurate flow and temperature conditions. These devices may be monitored via a local energy management system or alternatively via a remotely monitored BACNET interface. A temperature sensor 120 mounted in the zone that loads and unloads the compressors 114A and 114B controls space temperatures. As the compressors modulate, the discharge air temperature sensor 124 modulates the bypass air VAV box 126 to maintain the required discharge air temperature setpoint.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A VAV (variable air volume) air conditioning system comprising:

a means for modifying airstream temperature to produce a conditioned airstream whereby enhanced humidity control of said airstream is achieved;

a means for circulating air having a suction side and a discharge side, wherein a variable mixture of return air and outside air flow through said modifying means and the resultant conditioned airstream is supplied to said circulating air means suction side and thereby forms a discharge airstream at said discharge side;

a means for providing a source of heating or cooling;

a means for controlling rate of recycle of said discharge airstream to a point downstream of said airstream temperature and humidity conditioning means; and a means for maintaining and adjusting outside air flow as a function of discharge air recycle;

wherein said means for controlling the rate of recycle of said discharge airstream are modulated in response to variations in temperature of said discharge airstream and said means for maintaining and adjusting the outside air flow are simultaneously modulated whereby the volume of outside air supplied to said system is maintained at a constant value.

2. The VAV (variable air volume) air conditioning system of claim 1 wherein:

said means for modifying airstream temperature to produce a conditioned airstream is an evaporator coil.

3. The VAV (variable air volume) air conditioning system of claim 1 wherein:

said means for circulating air is a fan.

4. The VAV (variable air volume) air conditioning system of claim 1 wherein:

said means for providing a source of heating or cooling is at least one compressor.

5. The VAV (variable air volume) air conditioning system of claim 1 wherein:

said means for maintaining and adjusting outside air flow as a function of discharge air recycle is an outside air ventilation box characterized by an outside air damper constructed and arranged to control the volumetric flow rate of outside air.

6. The VAV (variable air volume) air conditioning system of claim 1 wherein:

said means for controlling the rate of recycle of said discharge airstream is a bypass air variable air volume box.

* * * * *